US005720134A

United States Patent [19]

Kurtz

[11] Patent Number: 5,720,134

[45] Date of Patent: Feb. 24, 1998

[54] POST HAVING PLASTIC BASE

[76] Inventor: William Kurtz, 2187 State Rd. #87, St. Croix, Wis. 54024

[21] Appl. No.: 775,860

[22] Filed: Jan. 2, 1997

[51] Int. Cl.[6] ..... E02D 27/42

[52] U.S. Cl. ..... 52/170; 52/165; 52/169.13; 52/309.16; 52/574; 52/721.2; 52/726.3; 52/736.1; 256/65; 403/339

[58] Field of Search ..... 52/101, 165, 169.1, 52/169.9, 169.13, 169.14, 170, 242, 309.1, 309.16, 574, 578, 720.1, 721.2, 721.3, 726.1, 726.2, 726.3, 726.4, 730.1, 731.1, 731.7, 731.8, 733.3, 736.1, 737.1, 737.2, 745.17, 745.18; 256/19, 59, 65, 69; 403/339, 340

[56] References Cited

U.S. PATENT DOCUMENTS

| | | | |
|---|---|---|---|
| 442,290 | 12/1890 | Leever | 52/165 |
| 996,262 | 6/1911 | Kurtz | 52/169.1 |
| 2,439,655 | 4/1948 | Graham | 403/340 X |
| 2,578,228 | 12/1951 | Clark | 52/726.3 |
| 3,135,364 | 6/1964 | Luttrell, Jr. | 52/165 |
| 4,386,762 | 6/1983 | Collins | 256/59 |
| 4,516,365 | 5/1985 | Chapman | 52/170 |
| 4,543,757 | 10/1985 | Cosgrove | 52/165 X |
| 4,646,489 | 3/1987 | Feller et al. | 52/165 |
| 5,090,165 | 2/1992 | Kenny | 52/165 |
| 5,203,817 | 4/1993 | Klumpjan | 52/170 X |
| 5,325,647 | 7/1994 | Forry et al. | 52/506.07 X |

*Primary Examiner*—Carl D. Friedman
*Assistant Examiner*—Kevin D. Wilkens

[57] ABSTRACT

A long-lasting base for supporting a structural post for a shelter-type structure for use principally on a farm. The base is made of an impervious material to avoid any rotting or deterioration which might result from moisture in the ground, and is formed to receive laminated posts as part of the structure.

4 Claims, 1 Drawing Sheet

POST HAVING PLASTIC BASE

BACKGROUND AND SUMMARY OF THE INVENTION

This invention pertains to shelter-type buildings commonly used on a farm and more particularly to a novel base for the structural posts which support such a building.

In present day farm structures designed for sheltering either livestock or forage crops it is common to erect buildings supported by a series of poles. In order to make it convenient to fasten either sheet metal or boards to the poles, those poles are usually wood. The poles are set into holes in the ground and which are then back filled to provide a relatively firm frame support.

Wood poles, particularly if untreated, are subject to rotting caused by moisture in the ground. In livestock shelter this moisture can be constant because of animal waste. In crop shelters such as hay shelters, the moisture comes principally from precipitation, but the moisture retention may be greater because the hay is set directly on the ground adjacent the post. Another problem is encountered in buildings such as houses set on coastal areas where ground water or termites may be a problem. Foundations for such houses, particularly those built on stilts can also make good use of the same poles of this invention.

Poles treated with asphalt or other materials are available. This treatment adds substantially to the cost of the pole because the material is impregnated into the wood of the pole under considerable pressure if it is to be effective. It also can be unpleasant for the people working with the treated wood. The materials used are frequently irritating to the skin so that even if gloves are used, exposed skin on the arm may be affected.

By applicant's invention, a non-irritating, long lasting base is provided on which a fabricated pole may be set so that the combination of a long life of the pole with the advantages of using nails driven into wood may be retained. Nails may also be driven into the base material if the holes are pre-drilled.

DESCRIPTION

Figure 1:
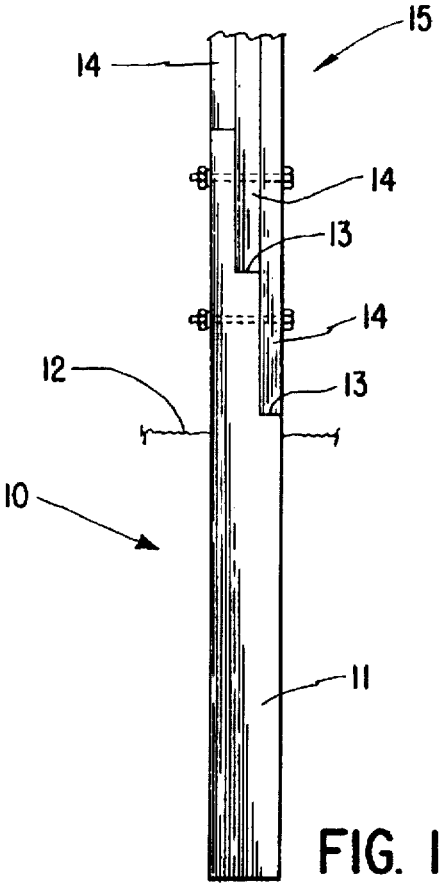
FIG. 1 is an elevational view of one side of the pole base.
Figure 2:
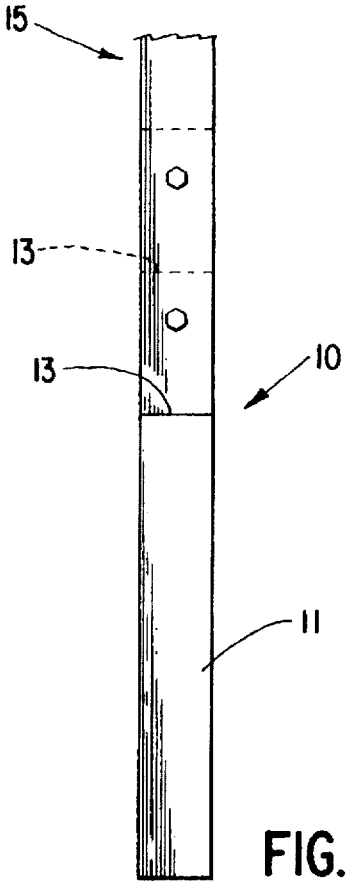
FIG. 2 is an elevational view of a second side of the base turned ninety degrees from the position of FIG. 1.

Briefly this invention comprises a long lasting support base for a structural post comprising part of a building. The base is made of an impervious plastic and is adapted to accommodate fabricated posts of varying sizes.

More particularly and referring to the drawings, the device of applicant's invention is a stump post 10 preferably rectangular in cross section. The lower part 11 is a simple plastic post adapted to extend well below the ground surface 12.

At its upper end, the post may be formed with steps 13 adapted to receive the lower end 14 of a wooden post 15. The preferred arrangement is to use of a series of boards laminated or bolted together to form a post so that each board reaches a single step. However, if the post is a solid square or rectangular cross section, it could be fabricated to provide steps. Still other arrangements may occur to people working in the art. For example, a circular post might have a socket in its base adapted to fit over a boss or protrusion on the top of the base. The desideratum is to keep the post itself in position on the base. The illustrated embodiment is preferred because the base and pole can be bolted together prior to erection and will generally be more stable.

The base is formed of a manufactured material such as a hard plastic which will be substantially impervious to moisture from the surrounding earth.

In use, a post hole is dug in the earth at a desired location. The assembled pole (in the preferred embodiment) is the placed in the hole and the hole is again filled with earth and tamped down to hold the pole. After the proper number of poles are placed, the building is erected in the usual manner.

Figure 4:
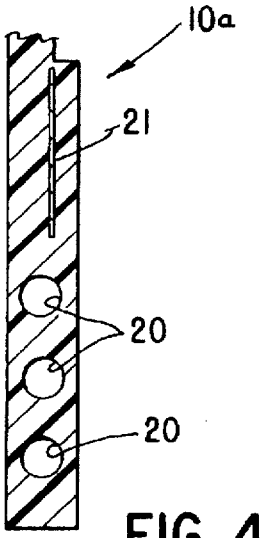
FIG. 4 is a sectional view from line 4—4 of FIG. 3.
Figure 3:
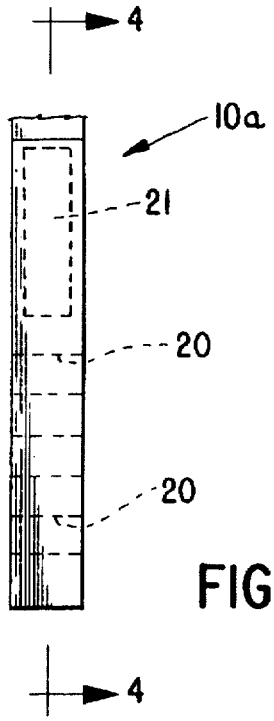
FIG. 3 is a partial elevational view similar to FIG. 2 of an alternative embodiment of the invention.

The alternative embodiment shown in FIG. 3 and 4 is simply a revision to lighten the weight of the base part and possibly to stiffen it. In those figures applicant shows a base part 10 a with a series of lightening holes 20 extending through the post. This formation reduces the amount of material used and does not substantially reduce the load-bearing strength. Also shown is a stiffening plate 21 which may be molded into the post if desired for stiffening he base. Applicant's tests have indicated that for most sizes of base post, such stiffening is not necessary although with some sizes, some molded insert of the sort may be desirable.

In use, the post is assembled by mounting the prefabricated wooden post 15 onto the base 10. A hole is dug to receive the structural post thus assembled. The base is then put into the hole to a depth such that the base extends above ground level enough to be free of moisture problems. The post can then be used as any other structural post for the assembly of a building. Thus applicant has provided a structural post relatively free of moisture problems while at the same time not requiring other treatment with caustic material. Tests also indicate that ground water does not leach any material from the new plastic bases where such is not true of some treatment materials used to treat wooden poles.

The invention also provides more ready portability of the buildings based on the novel bases. For example, if a building would be more useful in a different location from that first established, the bolts holding the post 15 to the base part 11 can be released, the building is then free to be moved. After the building has been moved off the original location, the base members may be pulled from the ground with a simple post puller, replaced at the new location and the building re-fastened to the bases where relocated.

I claim:

1. A structural post comprising a upper part having a top end and a bottom end, said upper part being formed of a plurality of side by side members, said members extending from said bottom end at varying distances, said distances varying in at least three steps from a longest distance at one side to a shortest distance at the other side remote from said one side, and a base part having a top and a bottom, said base being made of a material resistant to damage by moisture, said top of said base being formed to receive said members extending from said bottom end of said upper part in matching relationship.

2. The post of claim 1 in which fastening devices extend through said members extending from said bottom end of said upper part and through said top of said base whereby said base and said members extending from said upper part are fastened together.

3. The post of claim 1 in which said base is formed with lightening holes through the base.

4. The post of claim 1 in which stiffening means is enclosed in said base to provide added rigidity to said base.

* * * * *